US009136602B2

(12) United States Patent
Liu

(10) Patent No.: US 9,136,602 B2
(45) Date of Patent: Sep. 15, 2015

(54) WIRELESS COMMUNICATION DEVICE

(71) Applicant: FIH (Hong Kong) Limited, Kowloon (HK)

(72) Inventor: Chi-Sheng Liu, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 222 days.

(21) Appl. No.: 13/956,614

(22) Filed: Aug. 1, 2013

(65) Prior Publication Data

US 2014/0071007 A1 Mar. 13, 2014

(30) Foreign Application Priority Data

Sep. 10, 2012 (TW) ..... 101132904 A

(51) Int. Cl.
*H01Q 9/06* (2006.01)
*H01Q 9/04* (2006.01)
*H01Q 9/14* (2006.01)

(52) U.S. Cl.
CPC ..... *H01Q 9/06* (2013.01); *H01Q 9/0421* (2013.01); *H01Q 9/14* (2013.01)

(58) Field of Classification Search
CPC ..... H01Q 9/06; H01Q 9/0421; H01Q 9/14
USPC ..... 343/700 MS, 702, 745
See application file for complete search history.

(56) References Cited

U.S. PATENT DOCUMENTS

| | | | | | |
|---|---|---|---|---|---|
| 2,600,179 | A * | 6/1952 | Alford | 343/767 |
| 3,474,453 | A * | 10/1969 | Ireland | 343/745 |
| 5,883,600 | A * | 3/1999 | Kukura | 343/745 |
| 6,008,768 | A * | 12/1999 | Wilson et al. | 343/749 |
| 6,437,747 | B1 * | 8/2002 | Stoiljkovic et al. | 343/702 |
| 6,606,070 | B2 * | 8/2003 | Olson et al. | 343/745 |
| 7,176,840 | B1 * | 2/2007 | Kelley | 343/745 |

* cited by examiner

*Primary Examiner* — Tho G Phan
(74) *Attorney, Agent, or Firm* — Novak Druce Connolly Bove + Quigg LLP

(57) ABSTRACT

A wireless communication device includes a cover, an antenna, and an adjusting member. The antenna includes a first radiator and a second radiator separate from the first radiator. The adjusting member is slidably mounted to the cover and is made of conductive materials. The adjusting member is positioned between and connecting the first radiator and the second radiator. The adjusting member is slid relative to the cover to change connection positions of the adjusting member relative to the first radiator and the second radiator.

14 Claims, 3 Drawing Sheets

WIRELESS COMMUNICATION DEVICE

CROSS-REFERENCE TO RELATED APPLICATIONS

This application is one of the two related co-pending U.S. patent applications listed below. All listed applications have the same assignee. The disclosure of each of the listed applications is incorporated by reference into each of the other listed applications.

| Attorney Docket No. | Title | Inventors |
|---|---|---|
| US 46577 | WIRELESS COMMUNICATION DEVICE | CHI-SHENG LIU |
| US 46578 | WIRELESS COMMUNICATION DEVICE | CHI-SHENG LIU |

BACKGROUND

1. Technical Field

The present disclosure relates to wireless communication devices, and particularly to a wireless communication device having function of fine-tuning frequencies of wireless signals.

2. Description of Related Art

Antennas are important elements of wireless communication devices (such as mobile phones). When working conditions of the wireless communication devices change (e.g., ambient temperatures, humidity, and photographic methods), working characteristics of the antennas are easily influenced. Thus, frequency offset of the antennas may occur, i.e., the central frequencies of wireless signals send/received by the antennas may change. As a result, communication quality of the wireless communication devices may be adversely affected.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
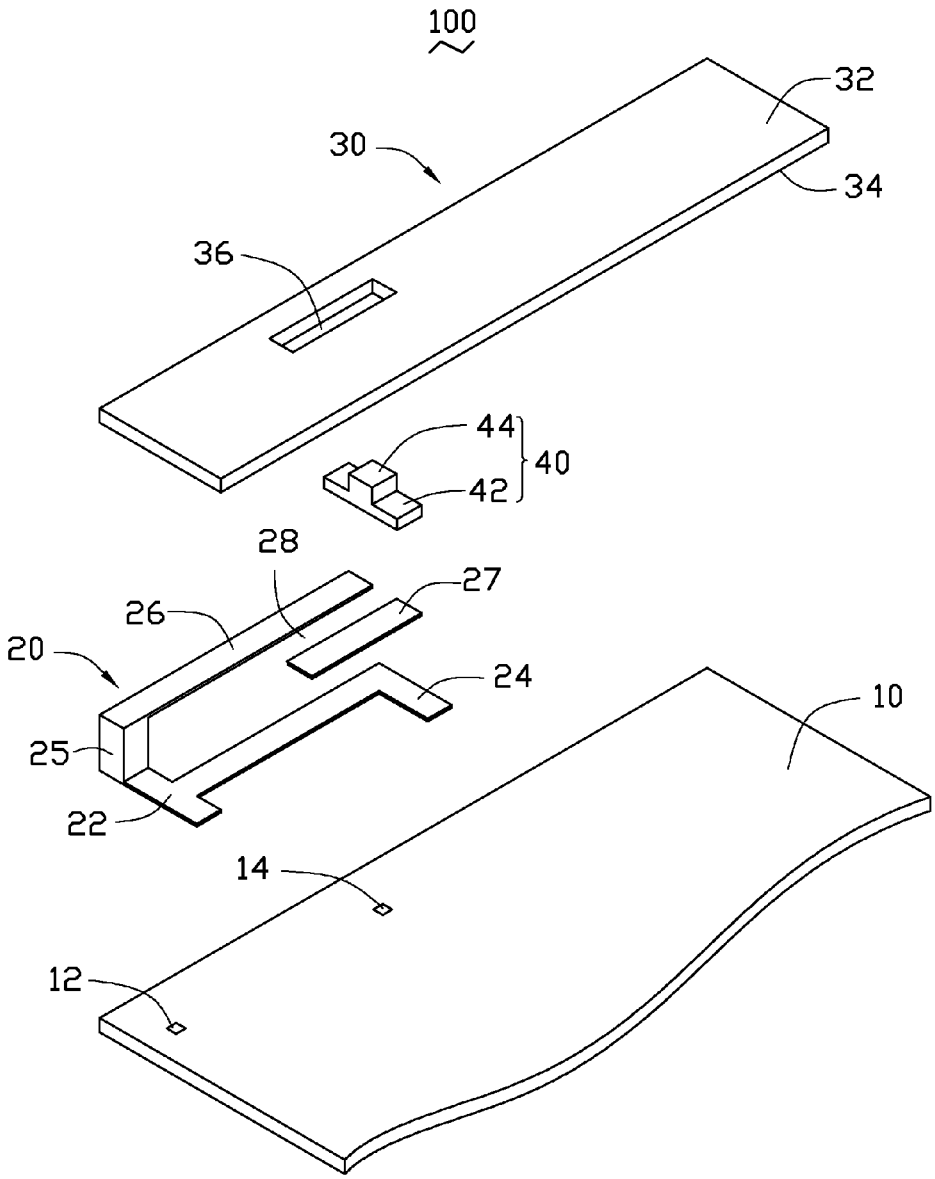
FIG. 1 is an exploded view of a wireless communication device, according to an exemplary embodiment.

FIG. 1 shows a wireless communication device 100, according to an exemplary embodiment. The wireless communication device 100 can be a mobile phone or a personal digital assistant (PDA).

In one exemplary embodiment, the wireless communication device 100 includes a base 10, an antenna 20, a cover 30, and an adjusting member 40.

The base 10 can be a printed circuit board (PCB) of the wireless communication device 100. A feed connector 12 and a grounding connector 14 are electrically mounted on the base 10. The feed connector 12 provides current to the antenna 20, and the antenna 20 is grounded by the grounding connector 14.

The antenna 20 is made of conductive materials, such as metal. The antenna 20 is used to receive/send wireless signals, such as wireless fidelity (WIFI) signals or global position system (GPS) signals. In the exemplary embodiment, the antenna 20 includes a feed end 22, a grounding end 24, a connecting portion 25, a first radiator 26 and a second radiator 27. The feed end 22 is a planar sheet, and is horizontally mounted on the base 10 and electrically connected to the feed connector 12. The grounding end 24 is a bent L-shaped sheet, a first end of the grounding end 24 is electrically connected to the grounding connector 14, and a second end of the grounding end 24 is connected to the feed end 22.

In one exemplary embodiment, the connecting portion 25 is a rectangle post. The connecting portion 25 is perpendicularly connected to the feed end 22 and the grounding end 24, and supports the first radiator 26 above the base 10.

Both the first radiator 26 and the second radiator 27 are a planar sheet parallel to the base 10. A connection end of the first radiator 26 is connected to an end opposite to the feed end 22 of the connecting portion 25. The second radiator 27 is coplanar with and separated from the first radiator 26. In one exemplary embodiment, the second radiator 27 is parallel to the first radiator 26 and separated there from by a gap 28. A first end of the second radiator 27 is aligned with a middle position of the first radiator 26, and a second end of the second radiator 27 is aligned with a distal end of the first radiator 26 opposite to the connection end of the first radiator 26.

The cover 30 covers the base 10 and the antenna 20, and includes an inner surface 32 and an outer surface 34 opposite to the inner surface 32. The cover 30 further defines a mounting hole 36 communicating with the inner surface 32 and the outer surface 34. When the antenna 20 is covered by the cover 30, the first radiator 26 and the second radiator 27 are substantially mounted on the inner surface 32.

The adjusting member 40 is made of metal or some other conductive material. The adjusting member 40 includes a connecting board 42 and an operating portion 44. The connecting board 42 is adjacent to the inner surface 32 of the cover 30, and thus a space (not labeled) is defined between the connecting board 42 and the inner surface 32 to receive at least a part of the first radiator 26 and the second radiator 27. In addition, a length of the connecting board 42 is greater than a width of the gap 28, to allow the connecting board 42 to transversely cross over the first radiator 26 and the second radiator 27 for connecting between the first radiator 26 and the second radiator 27. The operating portion 44 is formed on the connecting board 42, and passes through the mounting hole 36 to be slidable relative to the cover 30. Pushing the operating portion 44 with an external force causes the adjusting member 40 to slide relative to the cover 30 to change a connection position of the connecting board 42 relative to the first radiator 26 and the second radiator 27.

In one exemplary embodiment, an original connection position between the adjusting member 40 and the cover 30 is that the connecting board 42 connects between the distal end of the first radiator 26 and a second end of the second radiator 27. Thus, the antenna 20 can receive/send wireless signals at a central frequency of about 1575 MHz, such as GPS signals.

Figure 2:
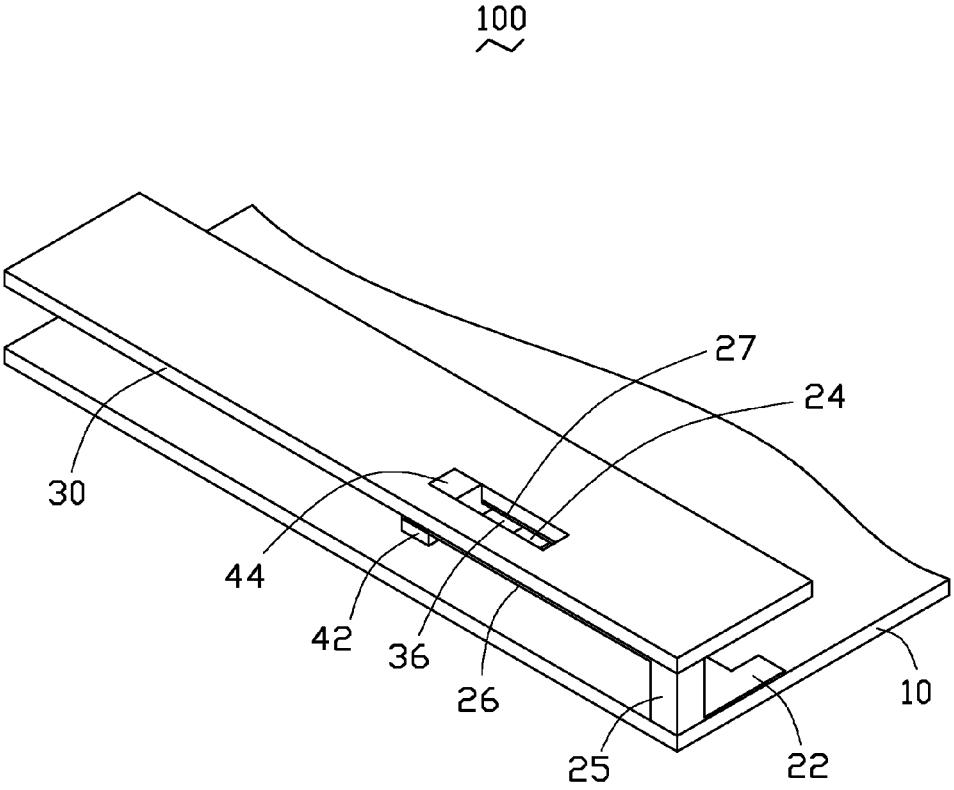
FIG. 2 is an assembled, isometric view of the wireless communication device of FIG. 1 in a first state.
Figure 3:
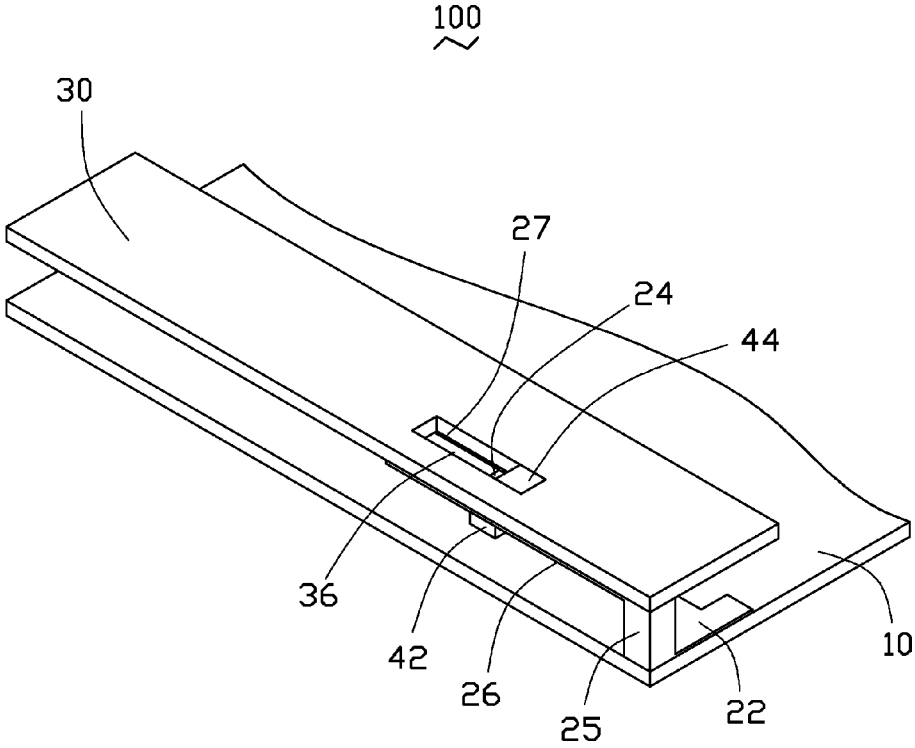
FIG. 3 is an assembled, isometric view of the wireless communication device of FIG. 1 in a second state.

FIGS. 2-3 show that when the wireless communication device 100 is in use, if working conditions of the wireless communication devices change (e.g., ambient temperatures, humidity, and photographic methods), frequency offset of the antenna 20 may occur. For example, if the central frequencies of the wireless signals decrease, the operating portion 44 can be pushed towards to the connecting portion 25, and the connection position of the connecting board 42 relative to the first radiator 26 and the second radiator 27 is changed, and thus, a length of the current path is decreased. Therefore, the central frequencies of the wireless signals increase, and the frequency offset of the antenna 20 is eliminated to receive/send desired wireless signals. For example, in the original connection position, an original current path is from the feed end 22 to the second radiator 27 via the connecting portion 25, the first radiator 26, and the connecting board 42. When the connecting board 42 is connected between the middle position of the first radiator 26 and a first end of the second radiator 27, a first current path is from the feed end 22 to the first radiator 26 via the connecting portion 25, and a second current path is from the feed end 22 to the second radiator 27 via the connecting portion 25, a part between the connection end and the middle position of the first radiator 26, and the connecting board 42. Thus, both the first current path and the second current path are shorter than the original current path.

Thereafter, if the central frequencies of the wireless signals increase, the operating portion 44 can be pushed away from the connecting portion 25, thus, the current path is increased. Thus, the central frequencies of the wireless signals are reduced, and the frequency offset of the antenna 20 is eliminated.

In other embodiments, the original connection position between the adjusting member 40 and the cover 30 can be changed. For example, one end of the connecting board 42 connects to a middle portion of the second radiator 27.

The adjusting member 40 can slide relative to the cover 30 to change the connection position of the connecting board 42 relative to the first radiator 26 and the second radiator 27. Thus, the current path of the antenna 20 can be adjusted to balance the central frequencies of the wireless signal received/sent by the antenna 20. Therefore, communication quality of the wireless communication device 100 can be improved.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A wireless communication device, comprising:

a base;

an antenna disposed on the base, the antenna including a first radiator and a second radiator separate from the first radiator;

a cover covering the base, the first radiator, and the second radiator; and an adjusting member slidably mounted to the cover and made of conductive materials; the adjusting member positioned between and connecting the first radiator and the second radiator;

wherein the adjusting member is slid relative to the cover to change a connection position of the adjusting member relative to the first radiator and the second radiator.

2. The wireless communication device as claimed in claim 1, wherein the cover comprises an inner surface and an outer surface opposite to the inner surface, both the first radiator and the second radiator are mounted on the inner surface.

3. The wireless communication device as claimed in claim 2, wherein the adjusting member comprises a connecting board, the connecting board is adjacent to the inner surface, and is connected between the first radiator and the second radiator.

4. The wireless communication device as claimed in claim 3, wherein the second radiator is parallel to and separated from the first radiator by a gap, a length of the connecting board is greater than a width of the gap to allow the connecting board to transversely cross over the first radiator and the second radiator.

5. The wireless communication device as claimed in claim 3, wherein the cover defines a mounting hole communicating with the inner surface and the outer surface, the adjusting member further comprises an operating portion, the operating portion is formed on the connecting board, and passes through the mounting hole.

6. The wireless communication device as claimed in claim 1, wherein a feed connector and a grounding connector are electrically mounted on the base, the antenna comprises a feed end and a grounding end, the feed end is a planar sheet, and is horizontally mounted on the base and electrically connected to the feed connector, a first end of the grounding end is electrically connected to the grounding connector, and a second end of the grounding end is connected to the feed end.

7. The wireless communication device as claimed in claim 6, wherein the antenna further comprises a connecting portion, the connecting portion is perpendicularly connected to the feed end and the grounding end, and supports the first radiator above the base.

8. The wireless communication device as claimed in claim 7, wherein both the first radiator and the second radiator are a planar sheet parallel to the base.

9. The wireless communication device as claimed in claim 8, wherein a first end of the second radiator is aligned with a middle position of the first radiator, and a second end of the second radiator is aligned with a distal end of the first radiator.

10. A wireless communication device, comprising:

a cover;

an antenna including a first radiator and a second radiator separated from the first radiator; and an adjusting member slidably mounted to the cover and made of conductive materials;

wherein the first radiator and the second radiator are mounted on the cover and are connected to each other through the adjusting member, the adjusting member is slid relative to the cover to connect the first radiator and the second radiator at different positions.

11. The wireless communication device as claimed in claim 10, wherein the cover includes an inner surface and an outer surface opposite to the inner surface, both the first radiator and the second radiator are mounted on the inner surface.

12. The wireless communication device as claimed in claim 11, wherein the adjusting member includes a connecting board, the connecting board is adjacent to the inner surface, and is connected between the first radiator and the second radiator.

13. The wireless communication device as claimed in claim 12, wherein the second radiator is parallel to and separated from the first radiator by a gap, a length of the connecting board is greater than a width of the gap to allow the connecting board to transversely cross over the first radiator and the second radiator.

14. The wireless communication device as claimed in claim 12, wherein the cover defines a mounting hole communicating with the inner surface and the outer surface, the adjusting member further includes an operating portion, the operating portion is formed on the connecting board, and passes through the mounting hole.

* * * * *